US008121504B2

(12) United States Patent
Umemoto et al.

(10) Patent No.: US 8,121,504 B2
(45) Date of Patent: Feb. 21, 2012

(54) APPARATUS AND METHOD FOR MEASURING OR CONTROLLING CONCENTRATION OF LIQUID DEVELOPER

(75) Inventors: Hiroaki Umemoto, Neyagawa (JP); Keyaki Yogome, Otsu (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 829 days.

(21) Appl. No.: 12/070,688

(22) Filed: Feb. 20, 2008

(65) Prior Publication Data

US 2008/0205921 A1 Aug. 28, 2008

(30) Foreign Application Priority Data

Feb. 27, 2007 (JP) ..... 2007-046907

(51) Int. Cl.
*G03G 15/00* (2006.01)

(52) U.S. Cl. ..... 399/58

(58) Field of Classification Search ..... 399/57, 399/58, 233, 237
See application file for complete search history.

(56) References Cited

U.S. PATENT DOCUMENTS 6,131,001 A 10/2000 Tsukamoto et al.
2007/0047985 A1* 3/2007 Kamijo et al. ..... 399/45

FOREIGN PATENT DOCUMENTS

| | | |
|---|---|---|
| JP | 06-277477 | 10/1994 |
| JP | 09-281808 | 10/1997 |
| JP | 10-198176 | 7/1998 |
| JP | 11-073029 | 3/1999 |
| JP | 2007-057772 | 3/2007 |

OTHER PUBLICATIONS

U.S. Appl. No. 12/157,482 entitled "Apparatus and Method for Adjusting Concentration of Liquid Developer," filed Jun. 11, 2008.
Japanese Office Action for Japanese Patent Application No. 2007-046907 dated Jul. 5, 2011 with English translation.

* cited by examiner

*Primary Examiner* — David Gray
*Assistant Examiner* — Barnabas Fekete
(74) *Attorney, Agent, or Firm* — Brinks Hofer Gilson & Lione

(57) ABSTRACT

Provided are an apparatus and method for measuring the concentration of liquid developer, and an apparatus and method for controlling the concentration of liquid developer in which the concentration of a highly concentrated developer is easily and accurately measured or controlled without controlling the liquid amount. An opening is provided in the developer container for concentration measurement in which a liquid developer for concentration measurement is stored and stirred for concentration measurement. The developer container for concentration measurement is configured such that the stored liquid developer for concentration measurement overflows through the opening at the time of stirring.

12 Claims, 10 Drawing Sheets

APPARATUS AND METHOD FOR MEASURING OR CONTROLLING CONCENTRATION OF LIQUID DEVELOPER

This application is based on Japanese Patent Application No. 2007-046907 filed on Feb. 27, 2007, in Japanese Patent Office, the entire content of which is hereby incorporated by reference.

TECHNICAL FIELD

The present invention relates to an apparatus and method for measuring or controlling the concentration of liquid developer used for image formation in an image forming apparatus.

BACKGROUND

What is commonly known in the prior art includes an image forming apparatus according to the electrophotographic method using a liquid developer. In such an image forming apparatus, an electrostatic latent image is formed on the photoreceptor, and this is developed by a liquid developer, whereby a toner image is formed. This toner image is transferred onto paper and is fixed thereon.

The liquid developer is formed by dispersing toner particles made up of resin and pigment into a carrier solution as an insulation solution exemplified by silicone oil in a high concentration. In order to develop an electrostatic latent image with this liquid developer, a thin layer of the developer of micron is formed on a developer carrier such as a development roller, and this thin-film developer is brought into contact with a photoreceptor.

As described above, when the liquid developer is used for development, formation of a uniform thin film of the developer of a predetermined concentration is crucial to obtain images with less variation of image density. To put it another way, it is important to maintain constant concentration of the liquid developer.

One of the techniques known in the conventional art to measure the concentration of the developer to maintain constant concentration of the liquid developer is the technique of calculating the developer concentration by detecting the light transmittance of the developer (Unexamined Japanese Patent Application Publication No. H09-281808 and Unexamined Japanese Patent Application Publication No. H11-73029). However, the method of calculating the developer concentration by light transmittance is accompanied by the problem of poor accuracy in measuring the concentration of highly concentrated developer. This is because, when the developer concentration is low, light transmittance is greatly changed by a change in concentration. However, when the concentration is increased, the light transmittance is reduced to the extent of reaching the point of saturation.

To solve this problem, the U.S. Pat. No. 6,131,001 discloses a method of using the viscosity of the developer to measure the concentration of a highly concentrated developer. The technique disclosed in this document uses, as the method of measuring the viscosity of developer, the method of obtaining the viscosity from the pressure difference of the developer in a pipe, the method of installing a viscometer in the tank accommodating the developer, and the method of obtaining the viscosity from the torque by the flowing developer. However, any of these methods has the problem of complicated structure and lack of sufficient precision.

Further, the Unexamined Japanese Patent Application Publication No. H06-277477 discloses the development of a technique of obtaining the viscosity of highly concentrated slurry (fuel mixture of coal and water) from the rotating torque in stirring operation by rotation, although this is not a liquid developer. However, despite comparatively simple measurement of the rotating torque, this technique has a defect of requiring the complicated procedure of calculating by detecting the amount of the liquid in a container.

SUMMARY

The object of the present invention is to solve the aforementioned problems and to provide a developer concentration measuring apparatus, developer concentration measuring method, developer concentration controlling apparatus and developer concentration controlling method wherein simple and highly sensitive measurement or control of the concentration of a highly concentrated developer can be ensured without the need for liquid amount control.

In view of foregoing, one embodiment according to one aspect of the present invention is an apparatus for measuring a concentration of a liquid developer:

a developer container having an opening, the developer container being adapted to contain the liquid developer for measurement;

a stirring mechanism which is adapted to stir the liquid developer contained in the developer container;

a load detector which is adapted to detect a load of stirring of the liquid developer when the liquid developer is stirred by the stirring mechanism; and a controller which is adapted to calculate the concentration of the liquid developer based on the load detected by the load detector when an excessive amount of the liquid developer is overflowing or has overflowed through the opening of the developer container.

According to another aspect of the present invention, another embodiment is an apparatus for controlling a concentration of a liquid developer, comprising:

a developer container having an opening, the developer container being adapted to contain the liquid developer for measurement;

a stirring mechanism which is adapted to stir the liquid developer contained in the developer container;

a load detector which is adapted to detect a load of stirring of the liquid developer when the liquid developer is stirred by the stirring mechanism;

a supply developer container which is adapted to contain a supply developer;

a supply mechanism which is adapted to supply the developer contained in the supply developer container to the developer container; and a controller which is adapted to control the supply of the supply developer by the supply mechanism based on the load detected by the load detector when an excessive amount of the liquid developer is overflowing or has overflowed through the opening of the developer container.

According to another aspect of the present invention, another embodiment is a method for measuring a concentration of a liquid developer, comprising the steps of:

containing the developer for measurement in a developer container having an opening;

stirring the liquid developer contained in the developer container;

detecting a load of the stirring of the liquid developer when an excessive amount of the liquid developer is overflowing or has overflowed through the opening of the developer container; and calculating the concentration of the liquid developer contained in the developer container based on the detected load.

According to another aspect of the present invention, another embodiment is a method for controlling a concentration of a liquid developer, comprising the steps of:

containing the developer for measurement in a developer container having an opening;

stirring the liquid developer contained in the developer container;

detecting a load of the stirring of the liquid developer when an excessive amount of the liquid developer is overflowing or has overflowed through the opening of the developer container; and controlling a supply of a supply developer to the liquid developer in the developer container based on the detected load.

DETAILED DESCRIPTION OF THE PREFERRED EMBODIMENT

The following describes the embodiment of the present invention with reference to drawings:

(Structure and Functional Operation of Image Forming Section)

Figure 1:
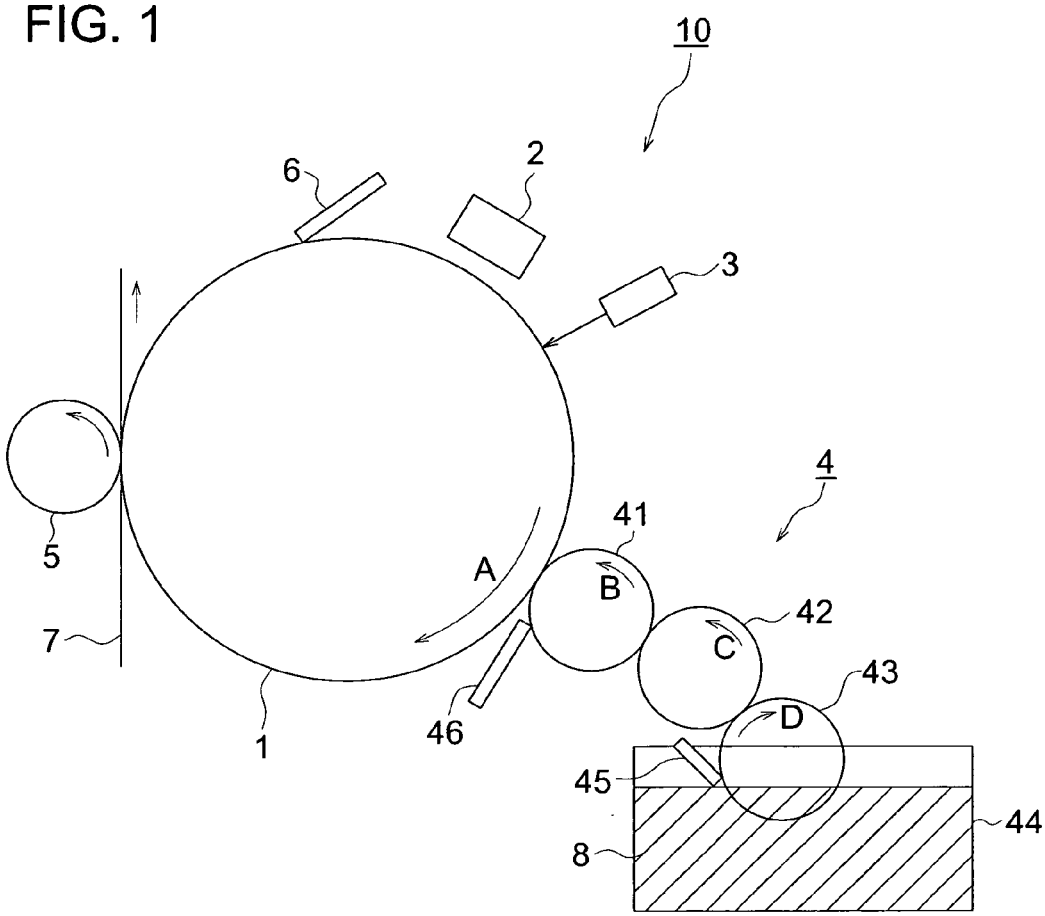
FIG. 1 is a cross sectional view of the schematic structure of the image forming section 10 of an image forming apparatus as an embodiment of the present invention.

FIG. 1 is a cross sectional view showing an example of the schematic structure of a wet type image forming apparatus as an embodiment of the present invention.

In FIG. 1, numeral 1 denotes a photoreceptor drum that serves as an image carrier. The image forming section 10 includes a charging apparatus 2 for uniform charging of the surface of the aforementioned photoreceptor drum 1 installed around the photoreceptor drum 1; an exposure apparatus 3 for forming an electrostatic latent image by applying LED or laser beam to the charged photoreceptor drum 1; a liquid development apparatus 4 for developing the electrostatic latent image with a liquid developer; a transfer apparatus 5 for transferring the developed toner image onto a transfer media 7; and a cleaning apparatus 6 for removing the liquid developer remaining on the surface of the photoreceptor drum after transfer.

Further, an apparatus for coating part of the liquid developer to the photoreceptor drum 1 in advance or an apparatus for recovering part of the extra liquid developer on the photoreceptor drum 1 may be installed before and after the liquid development apparatus 4. A recording material such as recording paper can be used as a transfer media 7. Alternatively, an intermediate transfer belt can be used as a transfer media 7 so that the image is transferred again onto a final recording material.

The liquid development apparatus 4 includes a development roller 41 that carries a thin layer of the liquid developer on its surface so as to develop the latent image on the photoreceptor drum 1 as an image carrier; a conveyance roller 42 which is in contact with the development roller 41 to transfer onto its surface the liquid developer whose amount is controlled; and a supply roller 43 which is in contact with the conveyance roller 42 for supplying its surface with the liquid developer 8 inside the developer container 44.

In FIG. 1, only one liquid development apparatus 4 is installed, but more than one liquid development apparatus 4 can be installed for color image formation. A desired color development method may be used, and the use or non-use of intermediate transfer may be determined as desired. A desired structure can be arranged depending of such options.

The photoreceptor drum 1 rotates in the arrow direction A in FIG. 1. The charging apparatus 2 charges the surface of the rotating photoreceptor drum 1 up to several hundred volts by corona discharge. On the downstream side of the charging apparatus 2 in the rotating direction of the photoreceptor drum, an electrostatic latent image whose surface potential is reduced to the level of a hundred volts is formed by the laser beam applied by the exposure apparatus 3.

A liquid development apparatus 4 is installed on the downstream side of the exposure apparatus 3, and the electrostatic latent image formed on the photoreceptor drum 1 is developed by the liquid developer 8.

In the liquid development apparatus 4, liquid developer 8 made of insulating solvent (hereinafter also referred to as "carrier solution") and toner particles dispersed therein is stored in the developer container 44, and the liquid developer 8 is supplied to the surface of the conveyance roller 42 by way of the supply roller 43.

The conveyance roller 42 conveys a thin layer of the liquid developer 8 and transfers it onto the development roller 41. A thin layer of liquid developer 8 is carried on the development roller 41. Further, the toner particles in the thin layer of liquid developer 8 carried on the development roller 41 is moved to the electrostatic latent image on the photoreceptor drum 1 by the potential difference between electrostatic latent images on the development roller 41 and photoreceptor drum 1, whereby an electrostatic latent image is developed.

The transfer apparatus 5 charges the transfer media 7 which is conveyed at the same speed as the peripheral speed of the photoreceptor drum 1, or applies voltage thereto, whereby the toner image developed on the photoreceptor drum 1 is transferred onto the transfer media 7.

A cleaning apparatus 6 for removing the liquid developer remaining on the surface of the photoreceptor drum 1 is installed on the downstream side of the transfer apparatus 5. The liquid developer 8 remaining on the photoreceptor drum 1 is removed by the cleaning apparatus 6.

The transfer media 7 with a toner image transferred thereon by the transfer apparatus 5, if it is a recording material, is fed to the fixing apparatus (not illustrated) and is heated to fix the image. If the transfer media 7 is an intermediate transfer media such as an intermediate transfer belt, the toner image is transferred again onto the recording material. The recording material with the toner image transferred thereon is fed to the fixing apparatus wherein the image is fixed, and the material is ejected.

(Developer Composition)

The following describes the liquid developer 8 used for development: In the liquid developer 8, colored toner particles are dispersed in carrier solution as a solvent at a high concentration. Additives such as a dispersant and charge regulating agent can also be added to the liquid developer 8.

The insulating solvent which is nonvolatile at the normal temperature is used as the carrier solution. Toner particles are mainly made of a resin and pigment or dye for coloring purposes. The resin has a function of uniformly dispersing the pigment or dye in itself and a function as a binder when fixing the image on the recording material.

The volume-average particle diameter of the toner is preferably in the range of 0.1 μm or more without exceeding 5 μm. If the toner average particle diameter is below 0.1 μm, development performances are much deteriorated. If the average particle diameter is over 5 μm, the image quality is deteriorated.

The percentage of the mass of toner particles to the mass of the liquid developer is preferably in the range of about 10 through 40%. If it is below 10%, toner particles tend to settle out, and this raises the problem of stability with time when stored for a long time. Further, to get required image concentration, a large quantity of developer must be supplied, and this will increase the amount of carrier solution attached on paper. The paper must be dried at the time of fixing, and environmental problem occurs due to the evaporated vapor. If this percentage is over 40%, the viscosity of the liquid developer will be excessive, and handling difficulties will occur in the manufacturing process.

(Structure and Operation of Development Apparatus)

Figure 2:
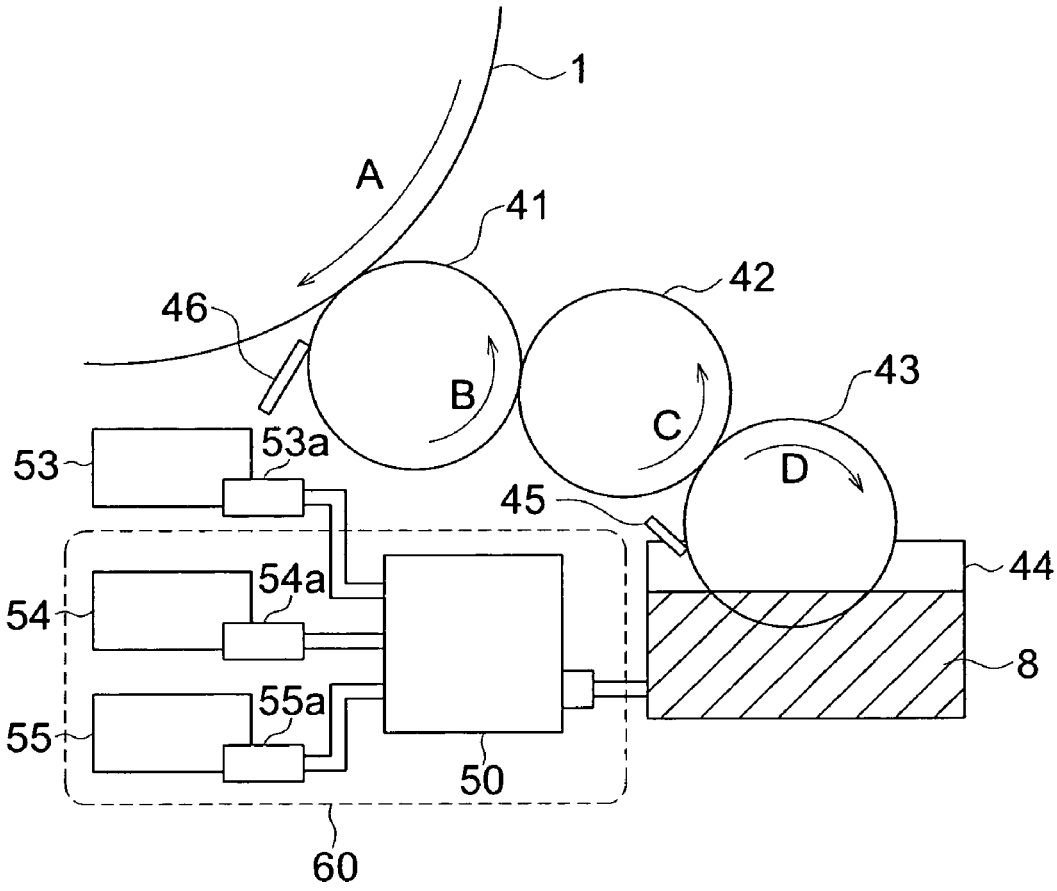
FIG. 2 is a layout drawing representing the schematic structure of the liquid development apparatus 4 of FIG. 1.

FIG. 2 shows the schematic structure of the, liquid development apparatus 4.

The developer container 44 accommodates liquid developer 8.

The supply roller 43 is arranged to be partially immersed in the liquid developer 8 in the developer container 44. Rotating in the arrow-marked direction D, this roller draws up the liquid developer 8 from the developer container 44. The high-viscosity liquid developer 8 is fed as it is attached to the surface of the supply roller 43 by its adhesibility.

The regulating member 45 is arranged so as to be in contact with the supply roller 43 in the counter direction to the rotating direction, as illustrated. It is intended to regulate the amount of the developer attached on the surface of the supply roller 43 to be fed. This arrangement peels down the excess amount of developer, and a thin layer of developer is formed on the surface of the supply roller 43, whereby the developer is fed to the next conveyance roller 42.

A rubber roller is generally used as a conveyance roller 42. The conveyance roller 42 is arranged face to face with the supply roller 43 and is rotated in the arrow-marked direction C in contact therewith. At this nip portion, a thin layer of developer formed on the surface of the supply roller 43 is transferred onto the surface of the conveyance roller 42 and is fed toward the development roller 41.

A low-hardness rubber roller is used as the development roller 41. The development roller 41 is arranged face to face with the conveyance roller 42, and is rotated in the arrow-marked direction B in contact therewith. At this nip portion, a thin layer of developer fed by the surface of the conveyance roller 42 is scraped off by the development roller 41, and a thin layer of developer is carried and fed by the surface of the development roller 41. Thus, the development roller 41 functions as the developer carrier.

In this case, the conveyance roller 42 forms a thin layer of developer which is conveyed to the developer carrier. The supply roller 43 may be designed to serve this function as well. To put it another way, it is possible to adopt the method wherein the developer is transferred from the supply roller 43 directly to the development roller 41.

The development roller 41 is rotated in contact with the photoreceptor drum 1 as an image carrier, and the latent image on the photoreceptor 1 is developed by a thin layer of developer fed to the nip portion relative to the photoreceptor drum 1, namely the development area.

However, after the latent image on the photoreceptor drum 1 has been developed, a thin layer of developer remains on the surface of the development roller 41. When the remaining developer is fed to the development area again without being removed, the next development may be adversely affected. The removing member 46 is a cleaning blade to remove the remaining developer.

(Structure for Collecting and Recycling the Developer)

FIG. 2 also shows the schematic structure for collecting and recycling the removed remaining developer in the liquid development apparatus 4.

As described above, the developer remaining on the development roller 41 is removed by the removing member 46. The recovered developer is collected in a container to be discarded, or is reused. The present embodiment employs a configuration in which the developer is efficiently used without a container for discarding by reusing the recovered developer.

The developer having been scraped off from the surface of the development roller 41 by the removing member 46 is stored in the recovered developer container 53 as a recovered developer.

The recovered developer stored in the recovered developer container 53 is fed to the developer concentration controlling apparatus 60 so that it is adjusted to a desired level of concentration and is reused. The recovered developer container 53 is provided with a recovered developer supply mechanism **53*a*. This recovered developer supply mechanism 53*a* is designed to feed the recovered developer to the developer concentration controlling apparatus 60**, and a normal pump capable of drive control can be used as this mechanism.

The recovered developer having been adjusted to a desired level of concentration by developer concentration controlling apparatus 60 is conveyed to the developer container 44 of the liquid development apparatus 4, wherein it is reused.

<Structure of the Developer Concentration Controlling Apparatus>

Figure 3:
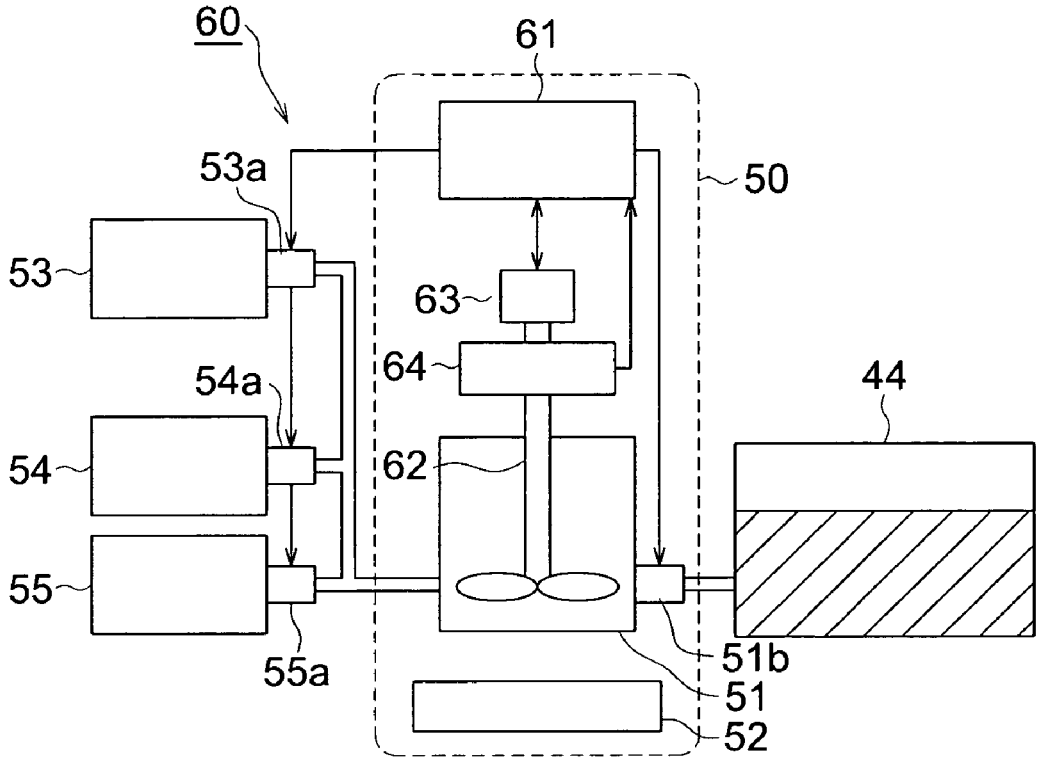
FIG. 3 is a layout drawing representing the schematic structure of the developer concentration controlling apparatus 60 and developer concentration measuring apparatus 50 of FIG. 2.

The schematic structure of the developer concentration controlling apparatus 60 of FIG. 2 is again shown in FIG. 3.

The developer concentration controlling apparatus 60 includes a developer concentration measuring apparatus 50, first supply developer container 54, first supply mechanism 54*a*, second supply developer container 55 and second supply mechanism 55*a*.

The first supply developer container 54 stores the liquid developer (including the case of carrier solution alone) having a concentration lower than a desired level, as the first supply developer. The developer is supplied to the developer concentration measuring apparatus 50 by the first supply mechanism 54*a*. A normal pump capable of drive control can be used as the first supply mechanism 54*a*.

The second supply developer container 55 stores the liquid developer of a concentration higher than a desired level as the second supply developer, for example, and this developer is sent to the developer concentration measuring apparatus 50 by the second supply mechanism 55*a*. A normal pump capable of drive control can be used as the second supply mechanism 55*a*.

In the developer concentration controlling apparatus 60, the recovered developer having been fed for concentration control is sent to the developer concentration measuring apparatus 50 as a developer for concentration measurement.

The developer concentration measuring apparatus 50 measures the concentration of the developer for concentration measurement. The first supply mechanism 54*a* or the second supply mechanism 55*a* is driven in response to the result of comparison between the developer for concentration measurement and a desired level of concentration, whereby the first supply developer or the second supply developer is supplied. To put it another way, if the concentration is higher than a desired level, the developer (first supply developer) of lower concentration is sent. If the concentration is lower than the desired level, the developer (second supply developer) of higher concentration is sent.

In the developer concentration controlling apparatus 60, measurement of the concentration by the aforementioned developer concentration measuring apparatus 50 and the supply of supply developer are continued until the concentration of the developer for concentration measurement reaches the desired level.

When the concentration of the concentration measurement developer has reached the desired level, concentration controlling procedure terminates. The developer for concentration measurement, the concentration of which has been controlled, from the developer concentration controlling apparatus 60 is supplied to the developer container 44 of the liquid development apparatus 4.

<Structure of Developer Concentration Measuring Apparatus>

The developer concentration measuring apparatus 50 includes a developer container for concentration measurement 51, ejected developer container 52, control section 61, stirring member 62, drive section 63, and load detector 64.

The developer container for concentration measurement 51 is used to store the developer for concentration measurement, and to measure the concentration. Driven by the drive section 63, the stirring member 62 stirs the developer for concentration measurement in the developer container for concentration measurement 51 and the load is detected by the load detector 64, whereby the concentration is measured.

Figure 4:
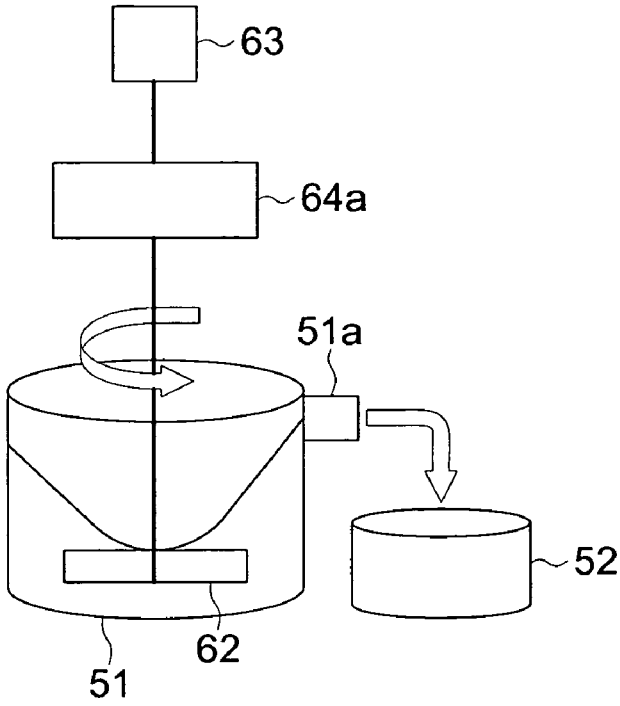
FIG. 4 is a configuration diagram of the apparatus for describing the operation of the developer concentration measuring apparatus 50.

FIG. 4 shows the schematic structure of the developer concentration measuring apparatus 50.

Figure 9:
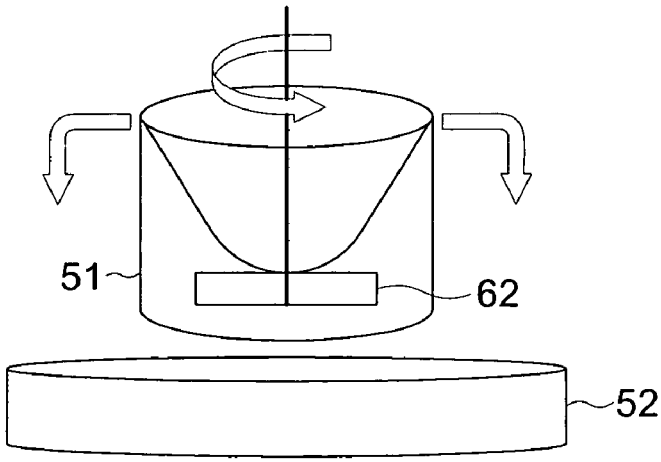
FIG. 9 is a diagram showing the developer concentration measuring apparatus wherein the overall upper end of the wall surface forms an opening.

The developer container for concentration measurement 51 is a cylindrical container, and an opening 51*a* is arranged on the side of the upper portion. When the liquid level has become higher than the opening due to an increase of the amount of the stored developer for concentration measurement, the excess amount of the developer flows out the opening, and thus, the opening 51*a* keeps the highest liquid level of the developer for concentration measurement at a constant level. The top end of the developer container for concentration measurement 51 defines an opening, as shown in FIG. 9. It is also possible to arrange such a configuration that the developer for concentration measurement overflows from the whole of the top end. The developer container for concentration measurement 51 is provided with a developer supply mechanism 51*b* (FIG. 3). This developer supply mechanism 51*b* is designed to feed the concentration-controlled developer to the developer container 44. A normal pump capable of drive control can be used as the developer supply mechanism 55*b*.

The ejected developer container 52 receives the aforementioned overflowing developer for concentration measurement, and stores it. It is possible to make such arrangements that the liquid developer remaining in the ejected developer container 52 is discarded, or is used as a recovered developer to be subjected to concentration control. When the top end of the developer container for concentration measurement 51 defines an opening, the ejected developer container 52 is arranged immediately below the developer container for concentration measurement 51 so as to receive the developer for concentration measurement overflowing from the whole of the top end, as shown in FIG. 9. The structure of FIG. 9 is adopted in the structure of FIG. 3. For ease of explanation of the function of the opening 51*a*, the structure of FIG. 4 will be used for the following description.

The stirring member 62 is a stirring blade, for example. It is installed inside the developer container for concentration measurement 51, and is driven and rotated by the drive section 63, whereby the stored developer for concentration measurement is stirred. The drive section 63 is a motor, for example, and is used to rotate the stirring blade as a stirring member 62 under predetermined conditions.

Figure 10:
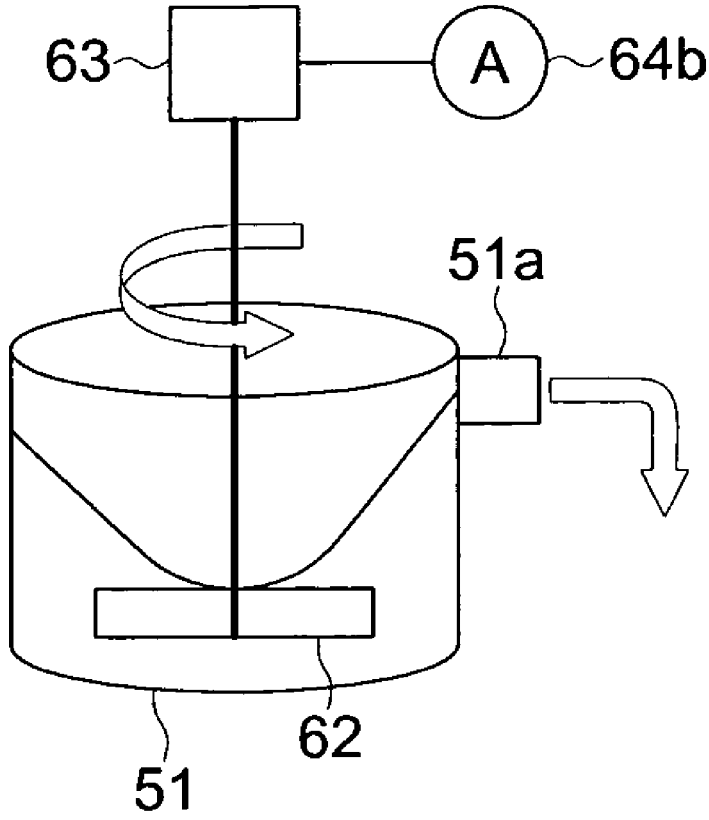
FIG. 10 is a diagram representing the developer concentration measuring apparatus using an ammeter as a load detector.

The load detector 64 is an apparatus to detect the load when the stirring member 62 is driven by the drive section 63. Various apparatuses can be used as the load detector 64. In the present embodiment, used is a load detector 64*a*, which is arranged between the motor 63 and stirring blade 62 for detecting the torque resulting from rotation of the stirring blade. The dynamic torque meter 64*a* detects the torque required to rotate the stirring blade at a predetermined rotational speed and sends the output value corresponding to that torque to the control section 61. As the load detector, an ammeter 64*b* can be used instead of this dynamic torque meter 64*a*, as shown in FIG. 10. The ammeter 64*b* measures the current required to rotate the motor 63 at a predetermined rotational speed and outputs the measurement result to the control section 61.

The control section 61 controls the operations of these components and calculates the concentration of the developer for concentration measurement or the value corresponding to the concentration. Further, based on the comparison with the desired level of concentration, the control section 61 controls the operation of supplying the first supply developer for concentration control or the second supply developer. The control section 61 can be made up of a microcomputer, memory, etc.

The aforementioned developer concentration measuring apparatus 50 is arranged in such a way as to calculate the concentration by detecting the load at the time of stirring the developer for concentration measurement. This is because the viscosity differs according to the concentration of the measurement developer, whereby the load for stirring is different.

Figure 5:
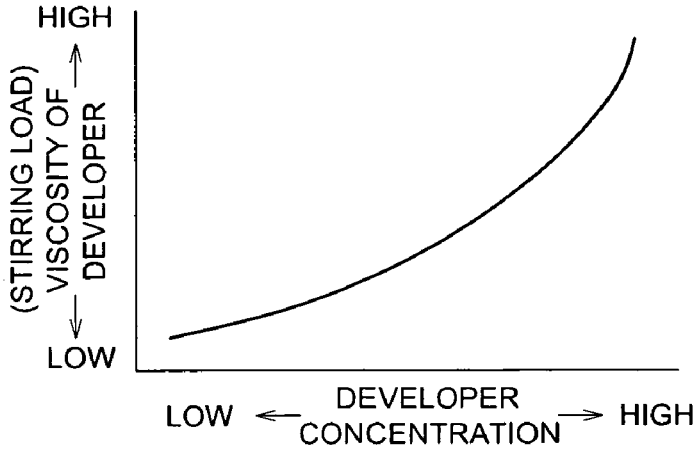
FIG. 5 is a chart representing the relationship between the concentration and viscosity of the liquid developer.

FIG. 5 is a chart representing the relationship between the concentration and viscosity of the developer.

The liquid developer is made of a carrier solution with the toner dispersed therein, as described above. The concentration of the liquid developer is expressed by the concentration of toner in the developer. As shown in FIG. 5, viscosity is changed if there is a change in the developer concentration. There is a great change in viscosity especially in the highly concentrated area, and a sufficient sensitivity of measurement is provided. Further, a change in the developer viscosity is accompanied by a change in the load required to stir it. Viscosity, hence concentration, can be measured from the stirring load, using this relationship.

To get the viscosity from stirring load, conditions at the time of stirring should be kept constant. Apparatus conditions as well as rotational conditions (if the stirring blade is to be rotated) and the amount of liquid developer to be stirred are kept constant. However, the following problems are involved in keeping the amount of liquid constant:

The time and effort for measurement are required to keep constant the amount of liquid to be measured. In the case of repeated measurements, the amount of liquid must be made constant at every measurement. The amount of the liquid will be increased if the developer for concentration control is replenished. Accordingly, the amount of the liquid must be controlled at every replenishment.

Figure 6A:
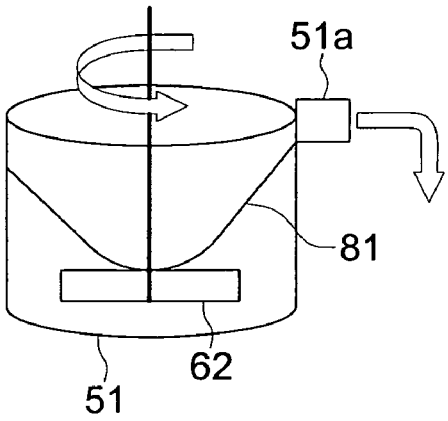
FIG. 6*a* is a diagram showing the liquid surface when stirring the low-viscosity developer.
Figure 6B:
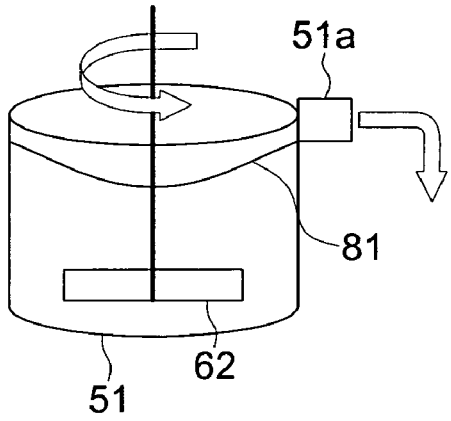
FIG. 6*b* is a diagram showing the liquid surface when stirring the high-viscosity developer.

The present embodiment does not use the method wherein the amount of liquid at the time of stirring is always kept constant at any viscosity. Instead, the present embodiment is arranged so that the amount of liquid at the time of stirring is kept at the same level for the developer of the same viscosity. To put it another way, when the developer has the same viscosity, liquid level is regulated to be constant by the opening 51*a*, whereby the same amount of liquid can be obtained. FIG. 6*a* and FIG. 6*b* show the difference in the liquid level at the time of stirring due to the difference in the developer concentration, i.e., the difference in the viscosity. FIG. 6*a* shows the situation of stirring the developer of low viscosity, and FIG. 6*b* shows the situation of stirring the developer of high viscosity. In this case, the stirring conditions are assumed as the same.

As will be apparent from the FIG. 6*a* and FIG. 6*b*, the liquid surfaces 81 are different between the high-viscosity developer and low-viscosity developer even under the same stirring conditions. In the case of a low viscosity developer (FIG. 6*a*), the developer liquid is moved outward by centrifugal force caused by the rotation of the stirring blade, and the liquid surface 81 forms a deep V-shape. By contrast, in the case of a high viscosity developer (FIG. 6*b*), the developer liquid does not move much outward by centrifugal force, and the liquid surface 81 forms a less deep V-shape.

Thus, if there is an opening 51*a*, the upper limit in the height of the liquid surface at the outermost portion is regulated, and the amount of liquid is changed according to developer viscosity. When control is conducted so that the developer overflows from the opening 51*a*, the amount of the developer of a predetermined viscosity can be kept to a predetermined level.

It goes without saying that the amount of liquid differs if there is a difference in developer viscosity. Since a predetermined liquid level, hence a predetermined amount of liquid, can be obtained in accordance with each viscosity, it is possible to conform the stirring load according to viscosity to the amount of liquid.

This arrangement eliminates the need of controlling the amount of liquid at every viscosity measurement. The required control is provided automatically by the opening 51*a*. Even if the developer of different concentration should be replenished during the measurement, the amount of liquid is automatically controlled in response to a change in viscosity.

Figure 7A:
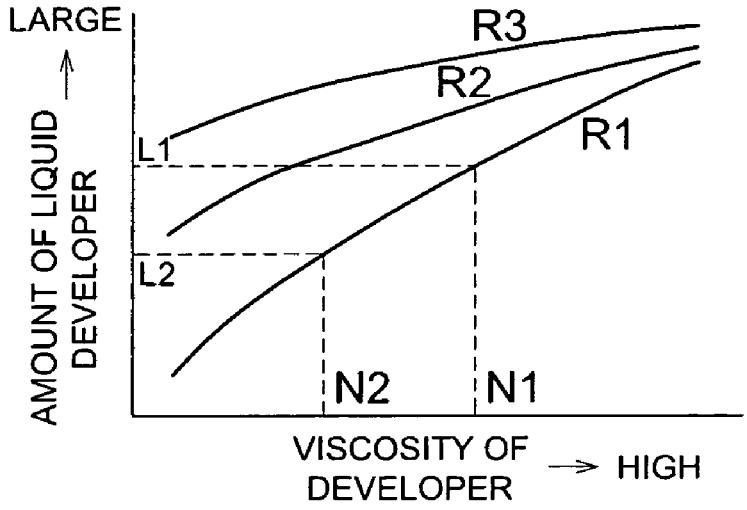
FIG. 7*a* is a diagram showing the relationship between the developer viscosity and the amount of liquid regulated by the opening at the time of stirring.
Figure 7B:
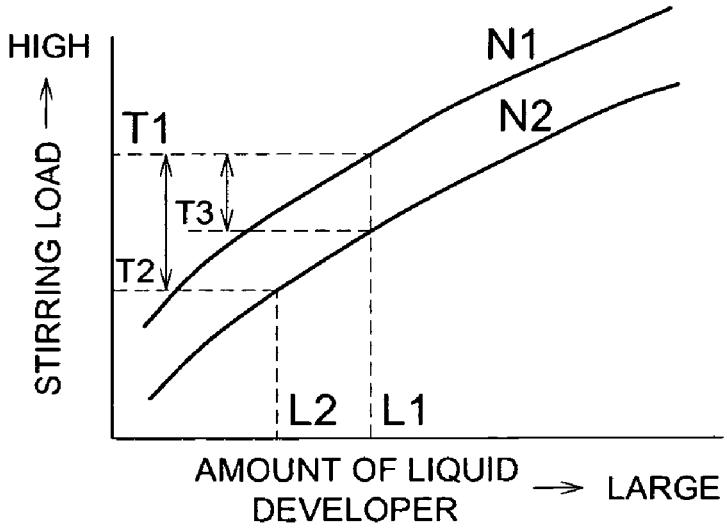
FIG. 7*b* is a diagram showing the relationship between the amount of developer liquid and the load of stirring.

Referring to FIG. 7*a* and FIG. 7*b*, the following describes that the developer viscosity, hence concentration, can be calculated from stirring load even if the amount of liquid is changed in response to the developer viscosity:

FIG. 7*a* is a diagram showing the relationship between the developer viscosity and the amount of liquid regulated by the opening at the time of stirring. FIG. 7*b* is a diagram showing the relationship between the amount of developer and the load of stirring. When these diagrams are put together, the relationship between the developer viscosity and stirring load can be obtained.

In FIG. 7*a*, the R1, R2 and R3 indicate the cases wherein there is a difference in the rotational speed of the stirring blade as a stirring member 62. The R1 denotes the greater rotational speed, R3 the smaller speed, and R2 the speed intermediate between them.

Particularly, when the speed is set to a greater level (R1), a change in developer viscosity appears as a difference in the amount of liquid developer regulated by the opening. When the developer viscosities are N1 and N2 (N1>N2), the amounts of liquid developer are L1 and L2 (L1>L2), respectively.

In FIG. 7*b*, N1 and N2 indicate the cases of different developer viscosities. N1 and N2 of FIG. 7*a* have the relationship of N1>N2. It is apparent that, as the viscosity is greater, the stirring load is greater; and as the amount of liquid developer is greater, the stirring load is greater.

In the present embodiment, the amount of liquid is regulated according to the developer viscosity. For example, the developers of viscosities N1 and N2 have the amounts of liquid of L1 and L2, respectively. As illustrated, for L1, the stirring load is T1 denoted by the crossing point of L1 and the chart N1. For L2, the stirring load is T2 denoted by the crossing point of L2 and chart N2. To put it another way, the difference between viscosity N1 and N2 appears as the difference between T1 and T2 in the stirring load.

Because of such a correspondence, even if a difference in the amount of liquid is caused by the developer viscosity, the corresponding viscosity, hence concentration, can be calculated from the stirring load.

Assume, on the other hand, that measurement is made according to a constant amount of liquid at all times without the amount of liquid being regulated by an opening. Again assume that, similarly, developer viscosities are N1 and N2 (N1>N2) in FIG. 7*b*. Since the amount of liquid is constant independently of viscosity, the stirring loads are T1 and T3 for N1 and N2, respectively, when the amount of liquid is assumed L1.

When the difference between T1 and T2 in this embodiment is compared with that of aforementioned T1 and T3, the difference between T1 and T3 is smaller. To put it another way, the measurement sensitivity according to the structure in the present embodiment is improved over the case wherein the amount of liquid is kept constant at the time of measurement.

(Operation of Measuring the Concentration in Developer Concentration Measuring Apparatus)

Figure 8:
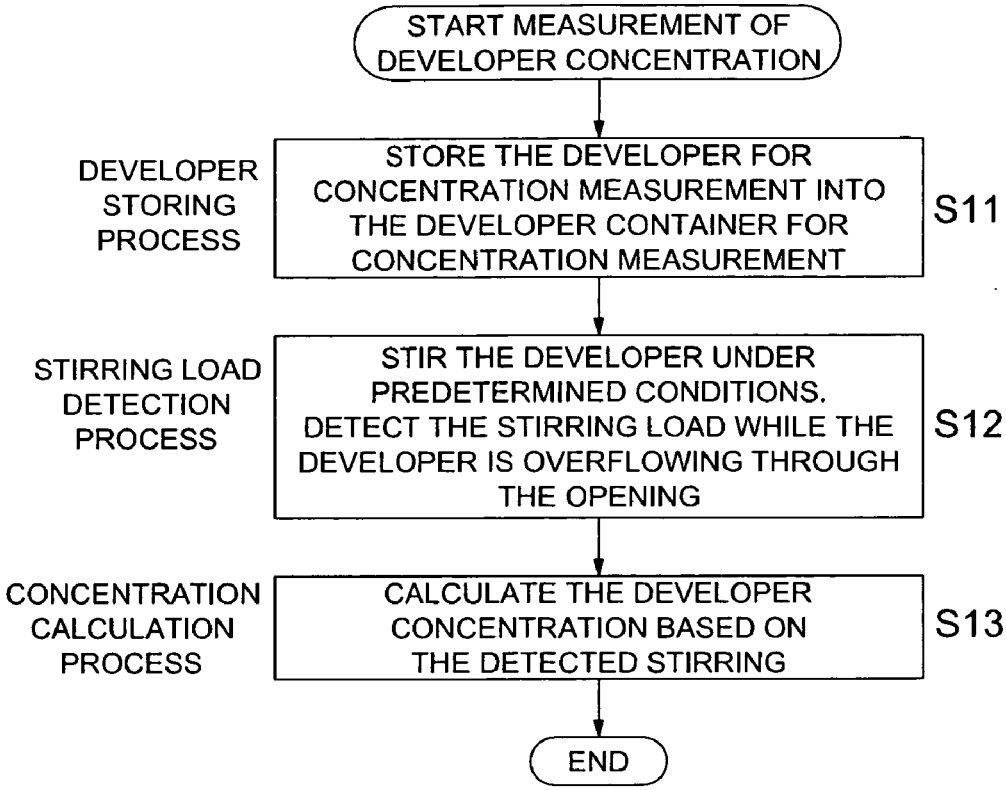
FIG. 8 is a flow chart showing the procedure of measuring the concentration in the developer concentration measuring apparatus.

FIG. 8 is a flow chart showing the procedure of measuring the concentration in the developer concentration measuring apparatus.

When the measurement of developer concentration has started, the control section 61 drives the recovered developer supply mechanism 53*a* in Steps S11 so that the developer for concentration measurement, i.e., the recovered developer collected in the recovered developer container 53 will be stored in the developer container for concentration measurement 51.

In this case, what is important is the amount of the developer to be stored. The developer must be made to overflow through the opening 51*a* at the time of measurement, i.e., at the time of stirring. The amount of developer to be stored must be set taking this into account. The amount of developer conforming to the maximum storage capacity has only to be stored for ease of operation.

In the next Step S12, the control section 61 makes the drive section 63 drive the stirring member 62. To put it more specifically, the stirring blade rotates at a predetermined rotational speed to stir the developer for concentration measurement. A commonly used method can be employed to control the rotating speed of the drive section 63. The liquid surface of the developer for concentration measurement is formed in a V-shape and, the excess developer flows to the ejected developer container 52 through the opening 51*a*. When the developer liquid level is placed under control, the stirring load is detected by the load detector 64, and the result of detection is inputted to the control section 61.

In this case, the stirring load must be detected after stirring has been started, and the amount of liquid developer has been changed and stabilized. Further, it is important at the time of stirring that the stirring blade should be immersed completely in the developer, and should be located sufficiently below the V-shaped liquid surface. This is essential to maintain high precision measurement.

In the next Step S13, the control section 61 calculates the developer concentration based on the stirring load having been detected.

When the correspondence between the stirring load and developer concentration is measured in advance, and the result is formulated in a Table stored in the control section 61, the developer concentration can be calculated merely by referencing the Table. Further, it is also possible to make such arrangements that the aforementioned correspondences shown in FIG. 7*a* and FIG. 7*b* are stored as relational expressions, and the viscosity and concentration are calculated whenever required.

When developer concentration is measured as part of the operation of controlling the developer concentration, calculation of the concentration is not always essential. It is sufficient to store the data of the stirring load corresponding to a desired level of concentration and to determine whether the level is greater or smaller than this data.

The process of calculating the developer concentration and measuring the developer concentration is now completed.

(Operation of Controlling the Concentration in Developer Concentration Controlling Apparatus)

Figure 11:
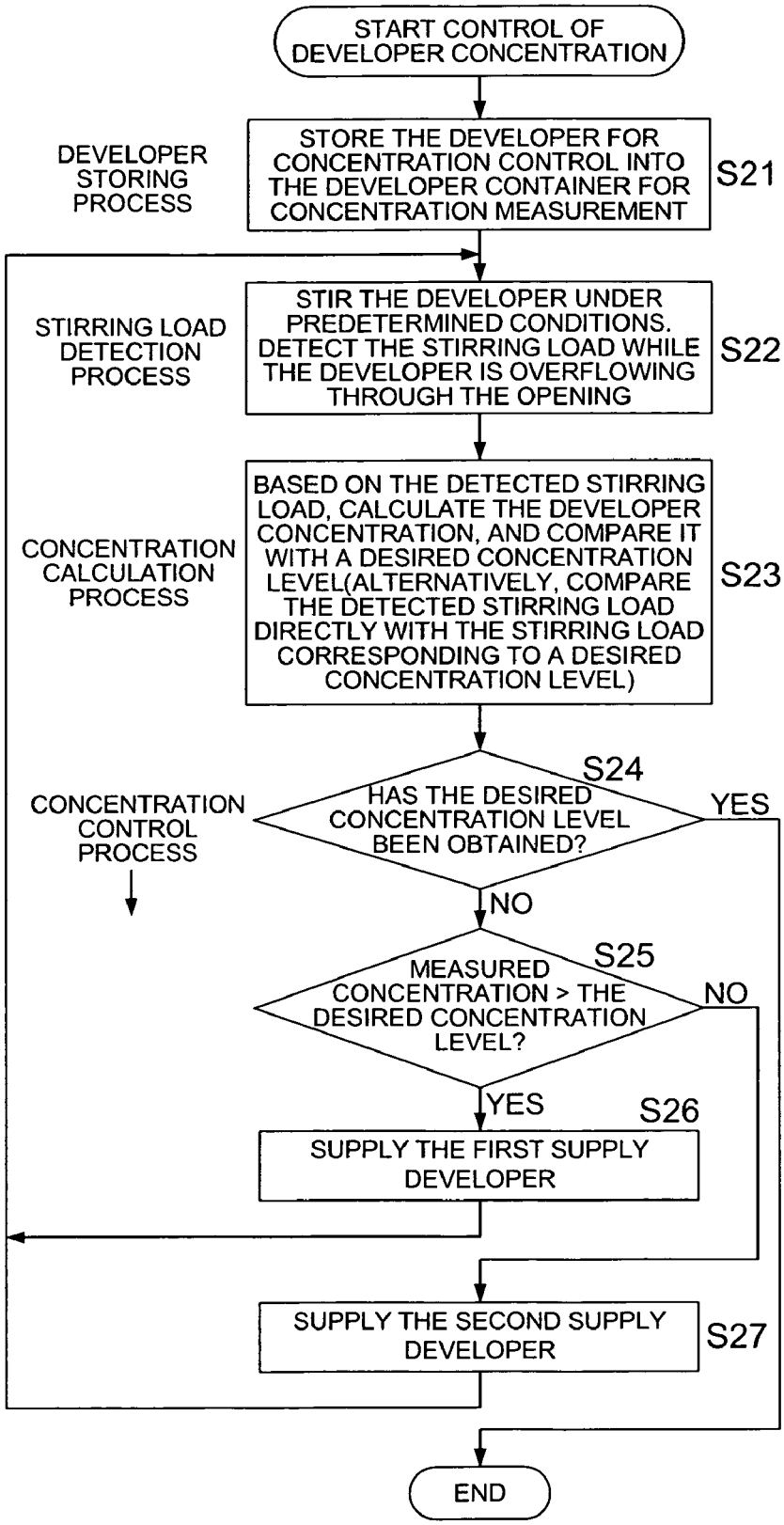
FIG. 11 is a flow chart representing the procedure of controlling the concentration in the developer concentration controlling apparatus.

FIG. 11 is a flow chart representing the procedure of controlling the concentration in the developer concentration controlling apparatus.

When the control of developer concentration has started, in Step S21, the control section 61 provides control in such a way that the developer for which the concentration is to be controlled, i.e., the recovered developer in the recovered developer container 53 is stored in the developer container for concentration measurement 51 as the developer for concentration measurement. This is the same as the Step S11 in the flow of measuring the developer concentration in FIG. 8.

This is followed by the Step S22 which serves as a step for detecting the stirring load, similarly to the Step S12.

The next Step S23 is basically the same as the Step S13 in the flow of measuring the developer concentration in FIG. 8. It serves as a step for calculating the concentration.

Here the purpose is not to calculate the concentration but to control the concentration to a desired level. It is sufficient only if it is possible to determine whether or not the concentration is higher or lower than the desired level and what the difference is. Thus, management for controlling the concentration can be directly made using the value of stirring load corresponding to concentration. In this case, the "concentration" in the following description should be read as the "stirring load value" corresponding thereto.

The concentration controlling process ranges from the next Step S24 to the End. While the concentration is controlled and the supply developer is replenished in the following process, the aforementioned stirring load detection and concentration calculation are continued. Based on these operations, the following concentration controlling process is also repeated until the concentration is reached the desired level.

In Step S24, a decision is made to see whether or not the concentration calculated in the aforementioned process has reached the desired level. A range of appropriate concentration is set in advance as the desired level of concentration by taking the concentration range into account, the concentration range which can be used in a liquid development apparatus. The control section 61 determines whether or not the calculated concentration lies within the range of concentration.

When the concentration reaches the desired level of concentration (Step S24: YES), the concentration controlling operation terminates. When the concentration does not reach the desired level of concentration yet (Step S24: NO), the procedure in Step S25 is executed.

In Step S25, a decision is made to see whether the calculated concentration is greater or smaller than the desired level. The range of concentration in Step S24 should be also used as a criterion for this step. In the case that the amount to be replenished is to be controlled in the subsequent Steps S26 and S27, how much greater of smaller may be calculated in this step.

When the calculated concentration is greater than the desired level of concentration (Step S25: YES), the procedure in Step S26 is executed. When the calculated concentration is smaller than the desired level of concentration (Step S25: NO), the procedure in Step S27 is executed.

In Step S26, the control section 61 causes the first supply mechanism 54*a* to replenish the first supply developer (low-concentrated developer) to the developer container for concentration measurement 51 from the first replenishing developer container 54. Since detection of the stirring load is continued during this time, replenishment and measurement are performed concurrently. This is enabled by the automatic control of the amount of liquid by the opening 51*a*.

If the replenishment speed of the first supply mechanism 54*a* can be changed, replenishment may be controlled based on the difference in concentration obtained in Step S25.

In Step S27, the control section 61 ensures the second supply mechanism 55*a* to replenish the second supply developer (high-concentration developer) to the developer container for concentration measurement 51 from the second replenishing developer container 55. Similarly to the case of Step S26, both replenishment and measurement are performed concurrently by the automatic control of the amount of liquid by the opening 51*a*.

If the replenishment speed of the second supply mechanism 55*a* can be changed, replenishment can be controlled according to the difference in concentration obtained in Step S25, similarly to the case of step S26.

If the concentration of the recovered developer is in the direction of getting higher, the second supply developer (high-concentration developer) has not to be replenished. Further, the second supply developer container 55 has not to be installed. If the concentration of the recovered developer is in the direction of getting lower, the first supply developer (low-concentration developer) has not to be replenished.

After the procedure in Step S26 or S27 has been executed, the system goes to Step S22, and stirring load detection and concentration controlling processes are continued concurrently until the desired level of concentration is obtained, as described above.

When a desired level of concentration is obtained (Step S24: YES), the control section 61 supplies the concentration-controlled developer of the developer container for concentration measurement 51 to the developer container 44 of the liquid development apparatus 4, and the developer concentration controlling terminates. Alternatively, control of the concentration of the next recovered developer can be started.

Figure 12:
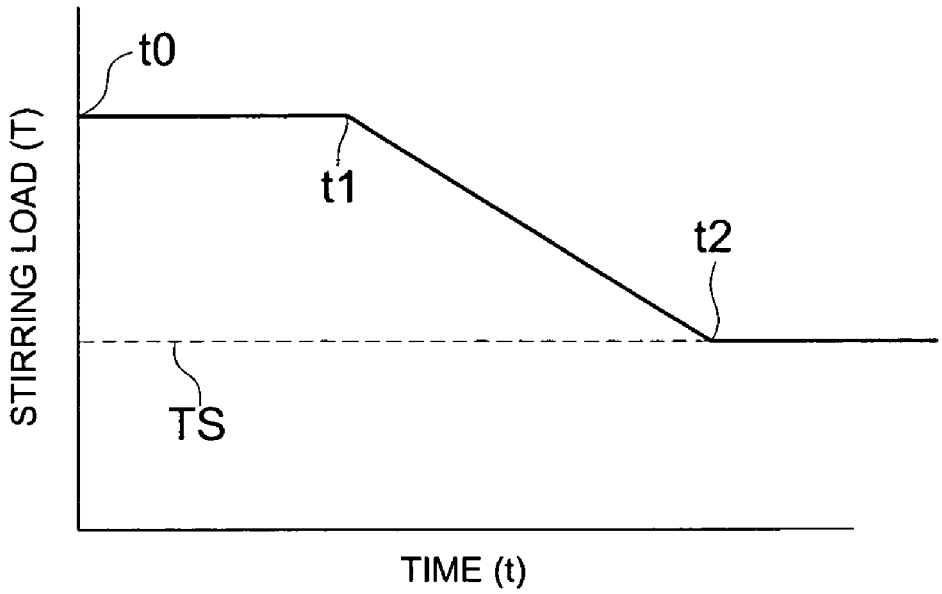
FIG. 12 is a chart representing an example of the change in stirring load T in the concentration controlling process.

FIG. 12 is a chart representing an example of the change in stirring load T in the concentration controlling process.

A change in the stirring load T with respect to the lapse of time t is represented by the curve T (t). The TS denotes a reference load, which indicates the stirring load corresponding to a desired developer concentration level. Thus, if the T (t) agrees with the TS, the desired level of concentration has been obtained.

In the chart of FIG. 12, t0 indicates the stirring load detection start-up time point. Detection of the stirring load T (t) starts at this time. In this example, the T (t) is greater than reference load TS. To be more specific, the concentration of the developer being measured is higher than the desired level of concentration.

The t1 denotes the concentration controlling startup time point. The supply of the first supply developer (low-concentration developer) starts at this time. Both the developer replenishment and stirring load detection are continued concurrently, and T (t) starts to reduce with the lapse of time t.

The t2 denotes the concentration controlling termination time point. During the period from t1 to t2, while the stirring load is detected, the supply of the supply developer continues if the detected T (t) is greater than the reference load TS. The T (t) reaches the reference load TS at the time point t2, and therefore, the replenishment of the developer terminates.

After that, the stirring load T (t) is equal to the reference load TS, and the concentration controlling terminates because the desired level of concentration has been obtained.

As described above, in the present embodiment, concentration can be easily calculated by only keeping the liquid level constant using the opening, without having to control the amount of liquid constant at the time of measuring the concentration. Further, both liquid replenishment and measurement can be performed concurrently. Thus, while the concentration is controlled by the supply developer, concentration can be measured. This arrangement realize a substantial reduction in the time and effort required to measure the developer. Further, the measurement sensitivity can be enhanced using a change in the liquid amount caused by concentration, i.e., viscosity. By controlling the concentration in this manner, the image forming apparatus can efficiently use the recovered developer whose concentration is accurately controlled.

It is to be expressly understood, however, that the present invention is not restricted to the aforementioned embodiments. The present invention includes the embodiment which is modified without departing from the spirit and scope of the invention claimed.

What is claimed is:

1. An apparatus for measuring a concentration of a liquid developer, the apparatus comprising:

a developer container having a sidewall and an opening, and adapted to contain the liquid developer for measurement;

a stirring mechanism adapted to stir the liquid developer contained in the developer container;

a load detector adapted to detect a load due to stirring of the liquid developer when the liquid developer is stirred by the stirring mechanism; and a controller configured to control a liquid surface of the liquid developer by controlling a speed at which the liquid developer is stirred to a selected speed so as to force the liquid surface upwardly along the sidewall of the container to a predetermined level, the predetermined level defined by a position of the opening of the developer container through which opening an excessive amount of the liquid developer is overflowing or has overflowed by stirring at the selected speed; and the controller configured to calculate the concentration of the liquid developer based on the load detected by the load detector when the liquid surface of the liquid developer is controlled to the predetermined level by stirring at the selected speed.

2. The apparatus for measuring the concentration of the liquid developer of claim 1, wherein the stirring mechanism includes:

a stirring blade which is provided in the developer container; and a drive section adapted to rotate the blade.

3. The apparatus for measuring the concentration of the liquid developer of claim 2, wherein the load detector includes a torque detector adapted to detect a rotation torque of the stirring blade.

4. The apparatus for measuring the concentration of the liquid developer of claim 2, wherein the drive section of the stirring mechanism includes an electric motor, and the load detector includes a current detector for detecting a drive current of the electric motor.

5. An apparatus for controlling a concentration of a liquid developer, comprising:

a developer container having a sidewall and an opening, and adapted to contain the liquid developer for measurement;

a stirring mechanism adapted to stir the liquid developer contained in the developer container;

a load detector adapted to detect a load due to stirring of the liquid developer when the liquid developer is stirred by the stirring mechanism;

a supply developer container adapted to contain a supply developer;

a supply mechanism adapted to supply the developer contained in the supply developer container to the developer container; and a controller configured to control a liquid surface of the liquid developer by controlling a speed at which the liquid developer is stirred to a selected speed so as to force the liquid surface upwardly along the sidewall of the container to a predetermined level defined by a position of the opening of the developer container, through which opening an excessive amount of the liquid developer is overflowing or has overflowed by stirring at the selected speed; and the controller configured to control the supply of the supply developer by the supply mechanism based on the load detected by the load detector when the liquid surface of the liquid developer is controlled to the predetermined level by stirring at the selected speed.

6. The apparatus for controlling the concentration of the liquid developer of claim 5, wherein the stirring mechanism includes:

a stirring blade which is provided in the developer container; and a drive section adapted to rotate the blade.

7. The apparatus for controlling the concentration of the liquid developer of claim 6, wherein the load detector includes a torque detector adapted to detect a rotation torque of the stirring blade.

8. The apparatus for controlling the concentration of the liquid developer of claim 6, wherein the drive section of the stirring mechanism includes an electric motor, and the load detector includes a current detector configured to detect a drive current of the electric motor.

9. The apparatus for controlling the concentration of the liquid developer of claim 5, further comprising:

a pair of supply developer containers, each container of the pair of supply developer containers containing a supply developer having a different concentration; and a pair of supply mechanisms, corresponding to the pair of supply developer containers, and configured to supply the supply developer contained in each container of the pair of supply developer containers, to the developer container.

10. The apparatus for controlling the concentration of the liquid developer of claim 5, wherein the controller calculates the concentration of the liquid developer in the developer container based on the load detected by the load detector while the supply mechanism is supplying the supply developer.

11. A method for measuring a concentration of a liquid developer, comprising the steps of:

containing the liquid developer for measurement in a developer container having a sidewall and an opening;

stirring the liquid developer contained in the developer container;

stirring the liquid developer at a selected speed so as to force a liquid surface of the liquid developer upwardly along the sidewall of the container to a predetermined level defined by a position of the opening of the developer container, such that an excessive amount of the liquid developer is overflowing or has overflowed through the opening by stirring at the selected speed;

detecting a load of the stirring of the liquid developer at the selected speed; and calculating the concentration of the liquid developer contained in the developer container based on the detected load at the selected speed.

12. A method for controlling a concentration of a liquid developer, comprising the steps of:

containing the liquid developer for measurement in a developer container having a sidewall and an opening;

stirring the liquid developer contained in the developer container;

causing the liquid developer to overflow through the opening of the developer container by stirring the liquid developer at a selected speed so as to force a liquid surface of the liquid developer upwardly along the sidewall of the container to a predetermined level defined by a position of the opening of the developer container, such that an excessive amount of the liquid developer is overflowing or has overflowed through the opening by stirring at the selected speed;

detecting a load of the stirring of the liquid developer at the selected speed; and controlling a supply of a supply developer to the liquid developer in the developer container based on the detected load at the selected speed.

* * * * *